United States Patent [19]

Niibe

[11] 4,149,066

[45] Apr. 10, 1979

[54] TEMPERATURE CONTROLLED FLEXIBLE ELECTRIC HEATING PANEL

[76] Inventor: Akitoshi Niibe, #4 Nishikubo, Sakuragawa-Machi, Shiba, Minato-ku, Tokyo, Japan

[21] Appl. No.: 633,654

[22] Filed: Nov. 20, 1975

[51] Int. Cl.[2] ..... H05B 1/02; H05B 3/36; H01C 7/00

[52] U.S. Cl. ..... 219/505; 219/212; 219/345; 219/358; 219/528; 219/549; 338/22 R; 338/23; 338/212; 338/255

[58] Field of Search ..... 219/345, 211, 212, 213, 219/504, 505, 528, 529, 544, 546, 547, 548, 549, 358, 551, 553; 252/510, 511; 338/22, 23, 210–214, 254–256, 292, 314, 328, 25, 26

[56] References Cited

U.S. PATENT DOCUMENTS

| | | | |
|---|---|---|---|
| 2,255,376 | 9/1941 | Bull et al. | 219/528 |
| 2,473,183 | 6/1949 | Watson | 338/212 X |
| 2,515,294 | 7/1950 | Cowgill | 338/212 X |
| 2,549,095 | 4/1951 | Huck | 219/504 |
| 2,559,077 | 7/1951 | Johnson et al. | 252/511 |
| 2,592,525 | 4/1952 | Huck | 219/505 UX |
| 2,745,942 | 5/1956 | Cohen | 338/212 X |
| 3,143,640 | 8/1964 | Becker | 219/528 X |
| 3,243,753 | 3/1966 | Kohler | 219/504 UX |
| 3,412,358 | 11/1968 | Hummel et al. | 338/210 X |
| 3,448,246 | 6/1969 | Armbruster | 219/505 UX |
| 3,537,053 | 10/1970 | Snoberger et al. | 338/212 X |
| 3,584,198 | 6/1971 | Doi et al. | 338/212 X |
| 3,694,624 | 9/1972 | Buchta | 219/505 X |
| 3,852,570 | 12/1974 | Tyler | 338/26 X |

*Primary Examiner*—A. Bartis
*Attorney, Agent, or Firm*—James C. Wray

[57] ABSTRACT

A sheet-like thin flexible heat-emitting surface layer and a coextensive thin flexible serpentine heat-sensing layer are overlayed by thin flexible synthetic plastic sheets which are sealed peripherally. Lead wires from an electrical plug to the heat-emitting layer are interrupted by a controller which is operated by current flowing through the heat sensing layer. Increased heat changes conductivity and current in the heat sensing layer, causing the controller to interrupt or reduce power to the heat-emitting layer.

6 Claims, 5 Drawing Figures

TEMPERATURE CONTROLLED FLEXIBLE ELECTRIC HEATING PANEL

BACKGROUND OF THE INVENTION

This invention is a flexible panel heating system that is capable of sensing and controlling temperature. Panel heating systems are made thin and are characteristically flexible, but lack the capability of sensing surface temperature, which is necessary for safety. Therefore, a number of thermostats are evenly placed on heat-emitting surfaces. Since thermostats are not flexible, they give bulkiness although they are small in size. They sense temperature only at the points they are placed, and therefore are not very reliable.

The invention is concerned with sensing and controlling temperatures in a flexible heat-emitting surface system. Recently, a heat-emitting surface system of an insulation sheet coated with conductive paint in carbon has been put into practical use. In the field of temperature control every control is not necessarily reliable. This type of flexible heat-emitting surface system is thin and has characteristically high flexibility but lacks the capability of sensing surface temperature for safety. In a conventional temperature-sensing system, a number of thermostats have been evenly placed. In spite of their small size, thermostats have not been suitable for such temperature sensing agents due to the fact they are neither flexible nor thin. In a temperature sensing system with a number of thermostats evenly placed, those thermostats are capable of sensing temperature at their locations but not anywhere else. Therefore, they cannot be referred to as accurate surface temperature sensing agents and cannot settle the question of the safety of the units.

SUMMARY OF THE INVENTION

This invention has provided a solution to the problem. The aim of the invention is to offer a temperature controllable, thin, flexible and safe heat-emitting surface system. In the system the temperature sensing surface is placed on the heat-emitting carbon surface with an insulation sheet inserted between the two. These two surfaces are sandwiched by two insulation sheets. The entire unit is made into a piece of sheet. The temperature sensing system is composed of a mixture of plastic, silver, copper, etc., whose volume and conductivity in turn change according to the temperature. The heat-emitting carbon surface is coated and printed with carbon paint. One application of this invention is described herein.

A flexible panel heating system is featured with consecutive laminations of an insulation sheet, a heat-emitting carbon surface, an insulation sheet, a temperature sensing film and an insulation sheet. The temperature sensing film consists of electric conductive paint, whose conductivity changes according to the temperature.

This sensing system is placed on the heat-emitting carbon surface with an insulation sheet inserted between the two. The sensing film is composed of a mixture of plastic, silver, copper, etc. which, according to the temperature, changes its volume, which in turn changes its electrical conductivity. This temperature sensing film is printed, and the entire body is covered with insulation sheet. This technical innovation gives birth to a panel heating system which is capable of controlling temperature, and is thin and flexible.

In a preferred form of the invention a plastic film is glued on one side of a sheet, which is composed of cotton or synthetic fabric. The plastic film is comparatively heat resistant, water repellant, electrically insulating and flexible-like polyester or polyvinyl chloride. A heat-emitting carbon surface system consists of the fabric printed in the following manner. First, electrodes of highly conductive paint of silver powder and the like are printed along the side edges of the other surface of the fabric. Second, said entire other surface of the fabric is printed with conductive paint composed of carbon powder and other materials, which eventually makes the heat-emitting carbon surface system. The heat-emitting carbon surface system is sandwiched by insulation sheets of the same material and is welded at the edges by a high frequency sewing machine, or the like.

The temperature sensing surface is printed on the fabric side of an insulation sheet. The temperature sensing surface is made by printing a fret or serpentine path pattern on the fabric with conductive paint of a mixture of plastic with fine powder of silver, copper, carbon, etc. The plastic expands as the temperature rises, and the conductivity changes accordingly.

For example, conductivity may decrease as the plastic expands. By this mechanism the change in temperature may be monitored electrically. The temperature sensing surface is covered with an insulation sheet which is integrated with the heat-emitting structure by coating with plastic, such as polyester, or welding the sheets at the edges.

Main lead wires are connected with the electrodes on the heat-emitting surface, and second lead wires are connected to the ends of temperature sensing surface.

When the former lead wires are connected to an electric power source, electric current runs into the heat-emitting carbon surface through the electrodes, making the surface generate heat. The temperature sensing surface conducts control current in the second lead wires according to the change in conductivity caused by heat from heat-emitting carbon surface. In one embodiment the current to the main lead wires is reduced or stopped at the set temperature by monitoring the change in current in the second lead wires. By doing so, the heat sensing surface checks the excessive temperature rise in the heat-emitting carbon surface. The insulation sheets protect the heat-emitting carbon surface and the temperature sensing surface from water seeping through and also prevents electrical leakage.

This invention is concerned with the flexible heat-emitting carbon surface and heat sensing and control system. It not only is safe in preventing excessive heat-emittance but also is capable of detecting particularly excessive heat emittance and reacting properly.

In one form of the invention power is supplied to the second lead wires from a power source, and conductivity of the sensing surface controls current in the heat-emitting carbon surface. The level of current in the second lead wires is used to control the power supplied to the heat-emitting surface.

In another form of the invention the serpentine sensing surface acts as a transformer secondary, picking up current from alternations of the alternating current (AC) flowing in the heat-emitting surface. The output of the second lead wires is used to control input in the main lead wires.

Since the temperature sensing surface is made by printing conductive paint, it is not as bulky as thermostats. Because of this property, the temperature sensing surface is suitable for use with flexible heat-emitting sheets having thin overall construction.

One object of the invention is the provision of a heat sensing system for a flexible panel having a first flexible insulating layer, a flexible conductive pattern on the layer, the flexible conductive pattern having first and second ends, lead wires connected to the ends of the conductive pattern, and a second flexible insulating sheet placed on the pattern and sealed to the first layer around edges thereof, for electrically insulating the conductive pattern from outsides of the first layer and second sheet.

Another object of the invention is the provision of a flexible heat sensing system with a flexible conductive pattern made of a flexible plastic material with discrete conductive particles therein, whereby heating of the plastic material changes conductivity of the flexible conductive pattern.

A further object of the invention is the provision of a flexible heat sensing system with a flexible conductive material in a serpentine pattern extending back and forth across a flexible insulating layer.

Another object of the invention is the provision of a flexible heat sensing system on a flexible insulating sheet positioned beneath a flexible electrical insulating layer, a flexible heat-emitting surface on the layer, a second electrically and moisture insulating sheet overlying the layer, and wherein the sheets are peripherally sealed for insulating the conductive pattern from electrical and moisture contact.

The invention has as a further object the provision of a flexible heat sensing system as above described with a third flexible moisture and electrical insulation sheet, a heat-emitting surface on the third sheet, and power leads connected to the heat-emitting surface for connecting the heat-emitting surface to a source of electrical power, and further comprising means for sealing the sheets peripherally, thereby insulating the heat-emitting surface and the flexible pattern from moisture and electricity.

The invention has as a further object the provision of a flexible heat sensing system as above described with control means connected to the lead wires and to the power leads for controlling power supplied through the power leads to the heat-emitting surface in response to current flow variation in the lead wires.

A further object of the invention is the provision of a flexible heat sensing system with a flexible fabric on which a conductive pattern is placed, and further comprising an insulating sheet positioned beneath the fabric and further comprising a second insulating sheet positioned below the first insulating sheet, a second fabric mounted on the second insulating sheet between the first and second insulating sheets, first and second printed electrodes mounted on opposite edges of the second fabric, and first and second power leads connected to the first and second electrodes, and flexible conductive heat-emitting material printed on the second fabric between the first and second electrodes for conducting current between the first and second electrodes and emitting heat, a third insulating sheet placed on top of the pattern and means for peripherally sealing the sheets for electrically and moisture insulating the heat-emitting surface and the conductive pattern from ambient conditions and from each other.

These and other and further objects and features of the invention are apparent in the disclosure which includes the above and below specification and claims and which includes the drawings.

DETAILED DESCRIPTION OF THE DRAWINGS

A flexible heat sensing system is generally referred to by the numeral 1.

Figure 1:
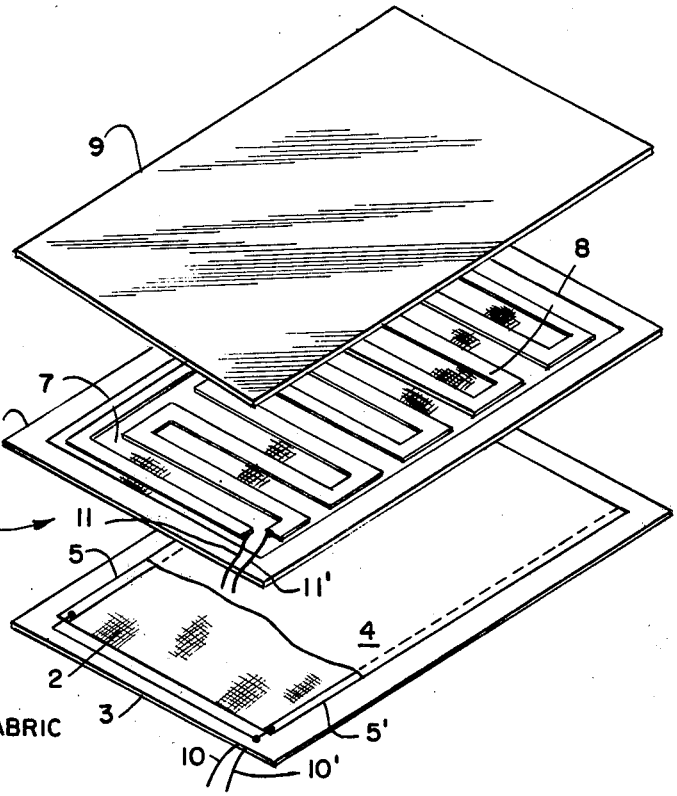
FIG. 1 is an exploded view of the elements of the flexible heat sensing system of the present invention.
Figure 1A:
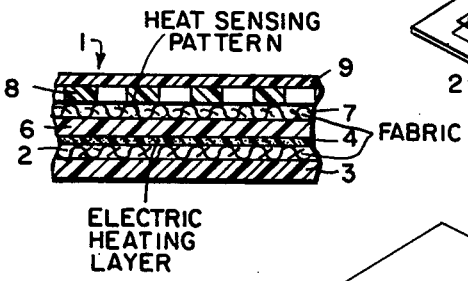
FIG. 1A is a cross sectional detail of the elements of FIG. 1 with the parts in assembled relationship.

As shown in FIG. 1 and 1A, an insulation sheet 2 is composed of cotton or synthetic fabric. A plastic film 3 is glued on one side of sheet 2. The plastic film 3 is comparatively heat resistant, water repellant, electrically insulating and flexible, and is made, for example, of polyester or polyvinyl chloride. The heat-emitting carbon surface system 4 consists of the fabric 2 printed in the following manner. First the electrodes 5 and 5' are printed with highly conductive paint of silver powder and the like along the edges of the exposed side of the fabric 2. Secondly, the entire exposed surface of the fabric 2 is printed with conductive paint composed of carbon powder and other materials, which eventually makes the heat-emitting carbon surface system 4. The heat-emitting carbon surface system 4 is sandwiched by the insulation sheets, 3 and 6 of the same material and is welded at the edges by a high frequency sewing machine, or the like.

The temperature sensing surface 8 is printed on a sheet of fabric 7 on the insulation sheet 6. This temperature sensing surface 8 is made by printing a serpentine pattern on the fabric 7 with conductive paint or a mixture of plastic with fine powder of silver, copper, carbon, etc. The plastic expands as the temperature rises, and the conductivity changes accordingly. By this mechanism the change in temperature may be monitored electrically.

Furthermore, the temperature sensing surface 8 is covered with insulation sheet 9 the temperature and sensing portion of the system is joined with the heat-emitting portion after either being coated with plastic, such as polyester, or being welded at the edges with the plastic sheet 9. All edges of sheets 3, 6 and 9 are joined and sealed.

Lead wires 10 and 10' connect electrodes 5 and 5' with a conventional power source. Second lead wires 11 and 11' are connected to the ends of temperature sensing surface 8.

Figure 2:
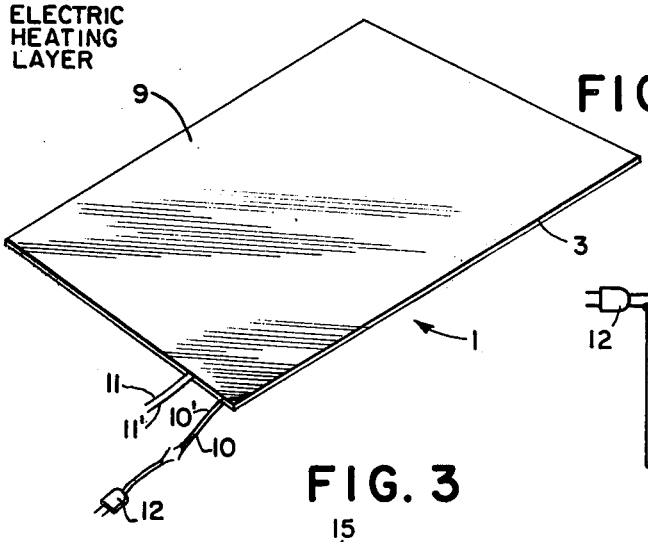
FIG. 2 is a perspective view of the assembled system.

As shown in FIG. 2, lead wires 10 and 10' are connected to a conventional plug 12.

When lead wires 10 and 10' are connected to an electric power source, electric current is supplied to heat-emitting carbon surface 4 through electrodes 5 and 5' and makes the surface generate heat. The temperature sensing surface 8 controls current in lead wires 11 and 11' according to the change in conductivity of surface 8 caused by heat from heat-emitting carbon surface 4 and means monitoring the change in current stops the current supply to lead wires 10 and 10'. By so doing, heat sensing surface 8 checks excessive temperature rise in heat-emitting carbon surface.

Figure 3:
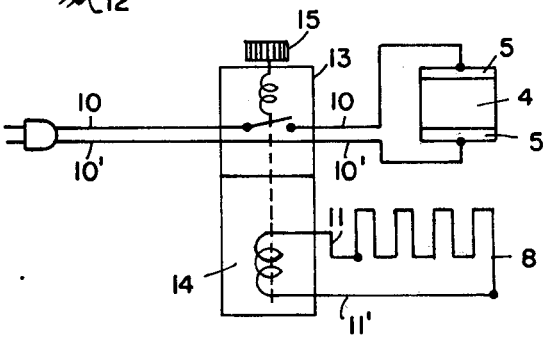
FIG. 3 is a schematic detail of a control for the heat sensing system of the present invention.

For example, as shown in FIG. 3, lead wires 10 and 10' are connected to an alternating current source plug 12 through normally closed relay contacts 13. Contacts 13 are held closed by a magnetized relay driver 14. As heat sensing surface 8 is heated its conductivity is increased. Current flow is induced in circuit 8 and leads 11 and 11' by current alternations in heat-emitting surface 4. When sufficient alternating current flows in circuit 11, 8, 11' because of the increased conductivity of surface 8, the permanent magnetic field in driver 14 is overcome, opening contacts 13 and stopping current flow through lead wires 10 and 10' to heat-emitting surface 4. When sensing surface 8 cools sufficiently, its conductivity is reduced, reducing current in lead wires 11 and 11' to below a level which overcomes the normal magnetic force in driver 14, allowing the contacts 13 to close. Knob 15 controls a spring to adjust the normal magnetic force in driver 14 and, hence, the heat cut-off level.

Figure 4:
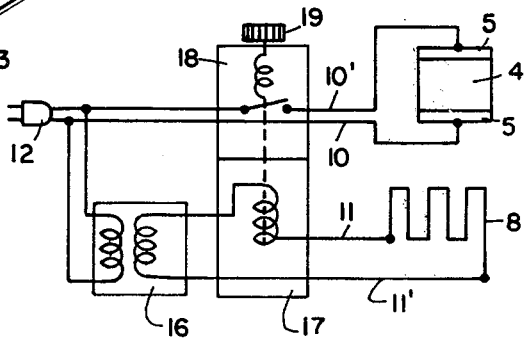
FIG. 4 is a schematic detail of an alternate control for the flexible heat sensing system of the present invention.

Alternatively surface 8 may be designed to become less conductive upon increased heat, reducing current flow to relay driver 14 until a level where contacts 13 are permitted to open. Contacts 13 are normally held closed by a current flow through the driver 14 which overcomes the permanent magnetic field of the driver tending to open the contacts, and contacts 13 are opened when the current in leads 11 and 11' drops below the level necessary to overcome the magnetic force of driver 14. As a further example as shown in FIG. 4 stepped down control voltage is supplied to leads 11 and 11' by transformer 16. Surface 8 becomes less conductive by virtue of expansion upon heating. Driver 17 senses reduced current flow in surface 8. Knob 19 adjusts the relationship of driver 17 and control 18 to vary the desired heat out-put of surface. Alternatively, lead 11' passes straight through driver 17, and lead 11 is wrapped around driver 17 to open control 18 upon reduced current flow in leads 11 and 11'. The insulation sheets 3 and 9 protect heat-emitting carbon surface 4 and temperature sensing surface 8 from water seeping through and also prevents electrical leakage. As explained, this invention is concerned with the flexible heat-emitting surface system 4 equipped with the temperature sensing surface 8 which is laminated and integrated with the heat emitting carbon surface system 4. It is effective not only in preventing excessive heat-emittance, but also in detecting excessive heat emittance and reacting properly.

While the invention has been described with reference to specific embodiments, it will be obvious to those skilled in the art that modifications and variations of the invention may be constructed without departing from the scope of the invention. The scope of the invention in defined in the following claims.

I claim:

1. A temperature controlled flexible electric heating panel comprising a first thin flexible electrically insulating layer, a flexible heat sensitive changeably conductive pattern on the layer, said flexible heat sensitive changeably conductive pattern comprising a serpentine pattern extending back and forth across the flexible insulating layer between the lateral edges thereof, said flexible conductive pattern having first and second ends, lead wires connected to said ends, a second thin flexible electrically insulating sheet coextensive with said first layer and covering said conductive pattern, said second sheet being bonded to said first layer around the peripheral edges thereof, a third thin flexible electrically insulating sheet coextensive with and positioned beneath said flexible insulating layer, said second and third sheets being moisture insulating, said second and third sheets being peripherally sealed to each other for insulating the heat sensitive changeably conductive pattern from electrical and moisture contact, a fourth thin flexible moisture and electrical insulation sheet coextensive with and positioned below said third sheet, a thin flexible electric heat-emitting resistance layer disposed between said third and fourth sheets, said heat-emitting layer and said conductive pattern being substantially coextensive, power leads connected to the heat-emitting layer for connecting the heat-emitting layer to a source of electrical power, means for sealing the fourth and second sheets peripherally, thereby insulating the heat-emitting layer from moisture and electrical contact, control means connected to said power leads for controlling power supplied through the power leads to said heat-emitting layer, said control means including means connected to said lead wires for sensing the temperature induced current flow variations in said conductive pattern and means for varying the power supplied to said power leads in response to said current variation in said conductive pattern.

2. The flexible heat sensing system of claim 1 wherein the flexible heat sensitive changeably conductive pattern comprises a flexible plastic material with discrete conductive particles therein, whereby heating of the plastic material changes conductivity of the flexible conductive pattern.

3. The flexible electric heating panel of claim 1 wherein the first insulating layer is a flexible fabric on which the heat sensitive changeably conductive pattern is placed.

4. The flexible electric heating panel of claim 3, wherein said heat-emitting layer comprises a second fabric mounted on said fourth insulating sheet, first and second printed electrodes mounted on opposite edges of the second fabric, said power leads being connected to the first and second electrodes, and flexible electrically resistive heat-emitting material printed on the second fabric between the first and second electrodes for conducting current between the first and second electrodes and emitting heat.

5. The flexible electric heating panel of claim 1, wherein said control means is adjustable so that the temperature of said flexible panel can be selectively varied.

6. The flexible electric heating panel of claim 1, wherein said second, third and fourth sheets comprise thin synthetic plastic sheets.

* * * * *